US010117495B2

(12) United States Patent
Ogis

(10) Patent No.: US 10,117,495 B2
(45) Date of Patent: Nov. 6, 2018

(54) REFILLABLE LIQUID DISPENSING DEVICE

(71) Applicant: COLGATE-PALMOLIVE COMPANY, New York, NY (US)

(72) Inventor: Ilaria Ogis, Rome (IT)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/035,229

(22) PCT Filed: Nov. 7, 2013

(86) PCT No.: PCT/US2013/068867
§ 371 (c)(1),
(2) Date: May 7, 2016

(87) PCT Pub. No.: WO2015/069248
PCT Pub. Date: May 14, 2015

(65) Prior Publication Data

US 2016/0270508 A1 Sep. 22, 2016

(51) Int. Cl.
*A45D 34/04* (2006.01)
*A46B 11/00* (2006.01)
*B65B 1/04* (2006.01)

(52) U.S. Cl.
CPC ..... *A45D 34/041* (2013.01); *A46B 11/0062* (2013.01); *B65B 1/04* (2013.01)

(58) Field of Classification Search
CPC combination set(s) only.
See application file for complete search history.

(56) References Cited

U.S. PATENT DOCUMENTS 1,951,565 A 3/1934 Sonnett
2,758,755 A 8/1956 Schafler
4,427,039 A * 1/1984 Brooks ..... B65B 31/003 141/20
4,573,506 A * 3/1986 Paoletti ..... B65D 81/3211 141/27
4,726,700 A 2/1988 Gray
(Continued)

FOREIGN PATENT DOCUMENTS

EP 2047868 4/2009
GB 2 039 622 8/1980
(Continued)

OTHER PUBLICATIONS

WO 2005/101969, Turgeman, Nov. 3, 2005.*
(Continued)

*Primary Examiner* — David Walczak

(57) ABSTRACT

A system (100) for dispensing a fluid, such as a deodorant is provided. The system (100) includes a dispenser (102) defining a first reservoir (108) therein and comprising a check valve (112) communicating with the first reservoir (108) and an exterior of the dispenser (102). The system (100) also includes a refill cartridge (104) defining a second reservoir (128) therein and including a valve-piercing element (126) configured to be received through the check valve (112), such that, when the valve-piercing element (126) is received through the check valve (112), the second reservoir (128) of the refill cartridge (104) fluidly communicates with the first reservoir (108) of the dispenser (102) via the valve-piercing element (126).

15 Claims, 2 Drawing Sheets

(56) References Cited

U.S. PATENT DOCUMENTS

| | | | | |
|---|---|---|---|---|
| 5,366,309 | A * | 11/1994 | Springall | B05C 5/02 118/108 |
| 5,505,041 | A * | 4/1996 | Harlan | A45D 40/16 206/385 |
| 5,721,576 | A * | 2/1998 | Barinaga | B41J 2/17506 141/329 |
| 6,412,997 | B2 * | 7/2002 | Berke | A45D 34/04 401/138 |
| 6,530,094 | B1 | 3/2003 | Neo | |
| 6,923,222 | B2 * | 8/2005 | Gaines | A63B 41/12 141/384 |
| 7,004,213 | B2 * | 2/2006 | Hansen | A61J 1/2089 141/27 |
| 7,128,901 | B2 | 10/2006 | Jonas et al. | |
| 7,135,011 | B2 | 11/2006 | Powers et al. | |
| 8,540,595 | B1 | 9/2013 | Lin | |
| 2009/0194191 | A1 | 8/2009 | Turgeman | |

FOREIGN PATENT DOCUMENTS

| | | |
|---|---|---|
| GB | 2 137 181 | 10/1984 |
| GB | 2 229 380 | 9/1990 |

OTHER PUBLICATIONS

International Search Report and the Written Opinion of the International Searching Authority issued in International Application PCT/US2013/068867 dated Jul. 24, 2014.

* cited by examiner

REFILLABLE LIQUID DISPENSING DEVICE

CROSS-REFERENCE TO RELATED PATENT APPLICATIONS

This application is a U.S. national stage application under 35 U.S.C. § 371 of PCT Application No. PCT/US2013/068867, filed Nov. 7, 2013, the entirety of which is incorporated herein by reference.

BACKGROUND

Underarm antiperspirant and deodorant products are available in a variety of types, including gels, solids, and liquids that are rolled on. In such liquid, roll-on products, a dispenser is provided, which generally includes a housing and an applicator. The applicator may include a roll-on ball that supplies the liquid product onto the user. The housing generally contains a reservoir of the liquid, which, when the dispenser is inverted, may employ gravity to force the liquid to contact the applicator and flow along the applicator and ultimately to the intended surface (i.e., the underarm), where it may be spread via the rolling motion.

The packaging of such products, however, may result in a large amount of waste. Typically, the dispenser is designed for a single use. When the reservoir is emptied, the dispenser is thrown away. To avoid such waste, some designs may provide refill cartridges. The refill cartridges may be integrated into the dispenser housing or used to refill the reservoir, e.g., from outside the dispenser. Both options, however, have drawbacks, in terms of ease of use and manufacturing. For example, such refill cartridges may be susceptible to spillage during refill.

BRIEF SUMMARY

Embodiments of the present disclosure may provide a dispenser and/or refill cartridge for precision application of fluids, for example, for use with roll-on, underarm deodorant products. The dispenser may include a check valve, such as a self-sealing rubber valve, that extends through a wall of the dispenser. In some cases, the wall may be the "bottom" of the dispenser, e.g., opposite an applicator attached to the dispenser. The dispenser may include a dispenser reservoir therein, with the check valve communicating with the reservoir. The dispenser may also include a pressure relief valve configured to release gas contained in the reservoir when it exceeds a certain pressure.

The cartridge may include a refill reservoir and a valve-piercing element. The valve-piercing element may extend outwards and communicate with the reservoir. The valve-piercing element may be, for example, a hollow elongate structure (e.g., a hollow needle), with an outlet on or near a distal tip thereof.

To refill the dispenser reservoir, the valve-piercing element may be received through the check valve, such that the check valve seals with an outside of the valve-piercing element. The dispenser may then be actuated (e.g., squeezed) to discharge the fluid contained therein through the valve-piercing element, out the outlet, and into the dispenser reservoir. Air in the dispenser reservoir may be compressed by the introduction of the fluid from the dispenser, and may discharge through the pressure relief valve when the pressure exceeds a certain level, thereby avoiding the buildup of pressure that might otherwise oppose continued entry of the fluid from the refill cartridge reservoir into the dispenser reservoir.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
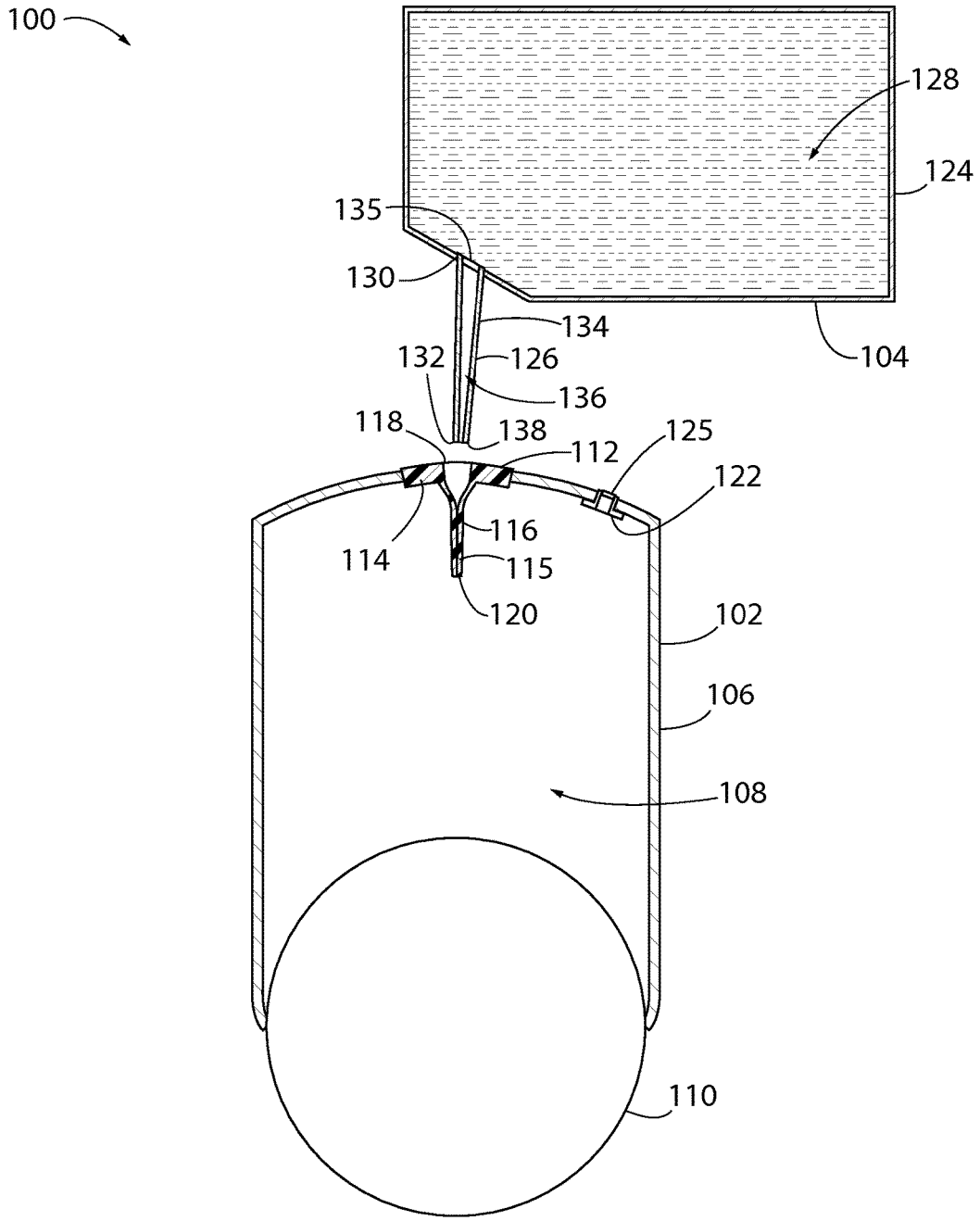
FIG. 1 illustrates a conceptual, cross-sectional view of a refillable dispenser system, according to an embodiment.

FIG. 1 illustrates a conceptual, cross-sectional view of a refillable dispenser system 100 configured for use, for example, with non-compressible fluidic underarm deodorant or antiperspirant products such as a liquid or a gel, according to an embodiment. The system 100 generally includes a dispenser 102 and a refill cartridge 104. The dispenser 102 may include a housing 106 that defines a dispenser reservoir 108 therein, which may be configured to contain a fluid (e.g., a non-compressible fluidic deodorant, such as a liquid or a gel). The dispenser reservoir 108 may be fluidly coupled with an applicator 110, such that fluid in the dispenser reservoir 108 may be conveyed to the applicator 110 and dispensed therefrom. The applicator 110 may be any suitable shape, size, etc., for example, a ball or sphere, as shown, which may rotate about one or more axes relative to the housing 106. The fluid in the dispenser reservoir 108 may have any suitable viscosity and may be any suitable deodorant, antiperspirant, or any other fluid suitable for the application in which it is used. In one embodiment, the fluid is at a constant ambient pressure inside the reservoir 108, i.e., the reservoir 108 is not pressurized.

The housing 106 may be fabricated at least partially from a plastic, for example, an injection or otherwise molded plastic. However, in other embodiments, any suitable material for the housing 106 may be employed. Further, the dispenser 102 may include any membranes, pistons, bags, ducts, etc. as may be desired to contain the fluid in the dispenser reservoir 108 and dispense it via the applicator 110 as needed.

The dispenser 102 may also include a check valve 112 for example, on a side opposed to the applicator 110, which may be referred to as the "bottom" of the dispenser 102, regardless of the actual orientation or attitude of the dispenser 102. In other embodiments, the check valve 112 may be positioned on a side of the dispenser 102. The check valve 112 may be, for example, a self-sealing elastomeric (e.g., rubber) valve. In one specific example, the check valve 112 may be analogous in form and/or function to a self-sealing inflation valve, such as those seen in inflatable balls. In an embodiment, the check valve 112 may include a base 114 and a body 115 extending therefrom and defining a one-way conduit 116 therethrough. Further, the body 115 may include a receiving end 118 coupled with the base 114 and a sealing end 120, distal to the base 114. The conduit 116 may communicate with an exterior of the housing 106 at the receiving end 118, and may communicate with the dispenser reservoir 108 at the sealing end 120. For example, the conduit 116 may extend into the reservoir 108.

Further, the conduit 116 may taper from an open diameter at the receiving end 118, to substantially a zero diameter at the sealing end 120. The taper may be gradual along the extent of the conduit 116, or may be more abrupt, e.g., toward the middle of the conduit 116, as shown. With the sealing end 120 having a zero diameter, the sealing end 120 may be closed, thereby sealing the check valve 112. The conduit 116 may, however, be flexible at least near the sealing end 120, so as to expand from the zero diameter by introduction of an expansion force, thereby opening the sealing end 120. In other embodiments, other types of self-sealing check valves may be employed, such as flapper valves.

The dispenser 102 may also include a pressure relief valve 122, which may also communicate with the reservoir 108 and an exterior of the housing 106, for example, by extending through the housing 106. The pressure relief valve 122 may have a valve element 125, which may be or include a flapper, ball, membrane, or another type of valve element that may be biased to a sealing position, or the like. The valve element 125 may be biased to a sealing position, such that the pressure relief valve 122 is closed as a default. When a pressure within the reservoir 108 applies a force on the valve element 125 that exceeds the force holding the valve element 125 in a sealed configuration, the pressure relief valve 122 may open, thereby releasing fluid (e.g., air) from the reservoir 108 to the exterior of the housing 106.

Turning to the cartridge 104, the cartridge 104 may include a pouch 124 and a valve-piercing element 126. The pouch 124 may define a refill reservoir 128 therein, which may contain a fluid and may fluidly communicate with the valve-piercing element 126. Further, the pouch 124 may be flexible, such that squeezing the pouch 124 may result in an increased pressure on fluid in the refill reservoir 128. In some instances, however, at least a portion of the pouch 124 may be rigid, so as to facilitate applying a moving force to the cartridge 104, as will be explained in greater detail below. Further, in some embodiments, the cartridge 104 may include a piston or another actuation device that may be configured to reduce a volume of the refill reservoir 128. In some embodiments, the refill reservoir 128 contains a non-compressible and/or non-pressurized fluidic deodorant, such as a liquid or a gel.

The valve-piercing element 126 may have a proximal end 130 coupled with the pouch 124, and may extend to a distal end 132, opposite the proximal end 130. Further, the valve-piercing element 126 may define a generally hollow, elongate body 134 between the ends 130, 132, which may define a conduit 136 extending therethrough. The cartridge 104 may also define a check valve 135, which may, for example, be one or more flappers that serve to retain fluid in the reservoir 128 until the fluid in the reservoir 128 is at a predetermined, heightened pressure (e.g., when the pouch 124 is squeezed or otherwise actuated), which may open the check valve 135 and release the fluid therethrough, as will be explained in greater detail below. In other embodiments, the check valve 135 may be a piece of the pouch 124 that is configured to rupture at the predetermined pressure. In still other embodiments, the pouch 124 may be punctured during or prior to assembling the valve-piercing element 126 with the pouch 124. In other cases, the check valve 135 may be unnecessary and omitted.

The valve-piercing element 126 may define an opening 138 at the distal end 132, which may communicate with the conduit 136. Accordingly, the refill reservoir 128 may communicate with the opening 138 via the conduit 136 so as to, for example, expel fluid through the valve-piercing element 126 and out of the opening 138. In other embodiments, the opening 138 may be formed along the body 134, near the distal end 132, such that the distal end 132 may be rounded, so as to protect the check valve 112 during insertion.

Figure 2:
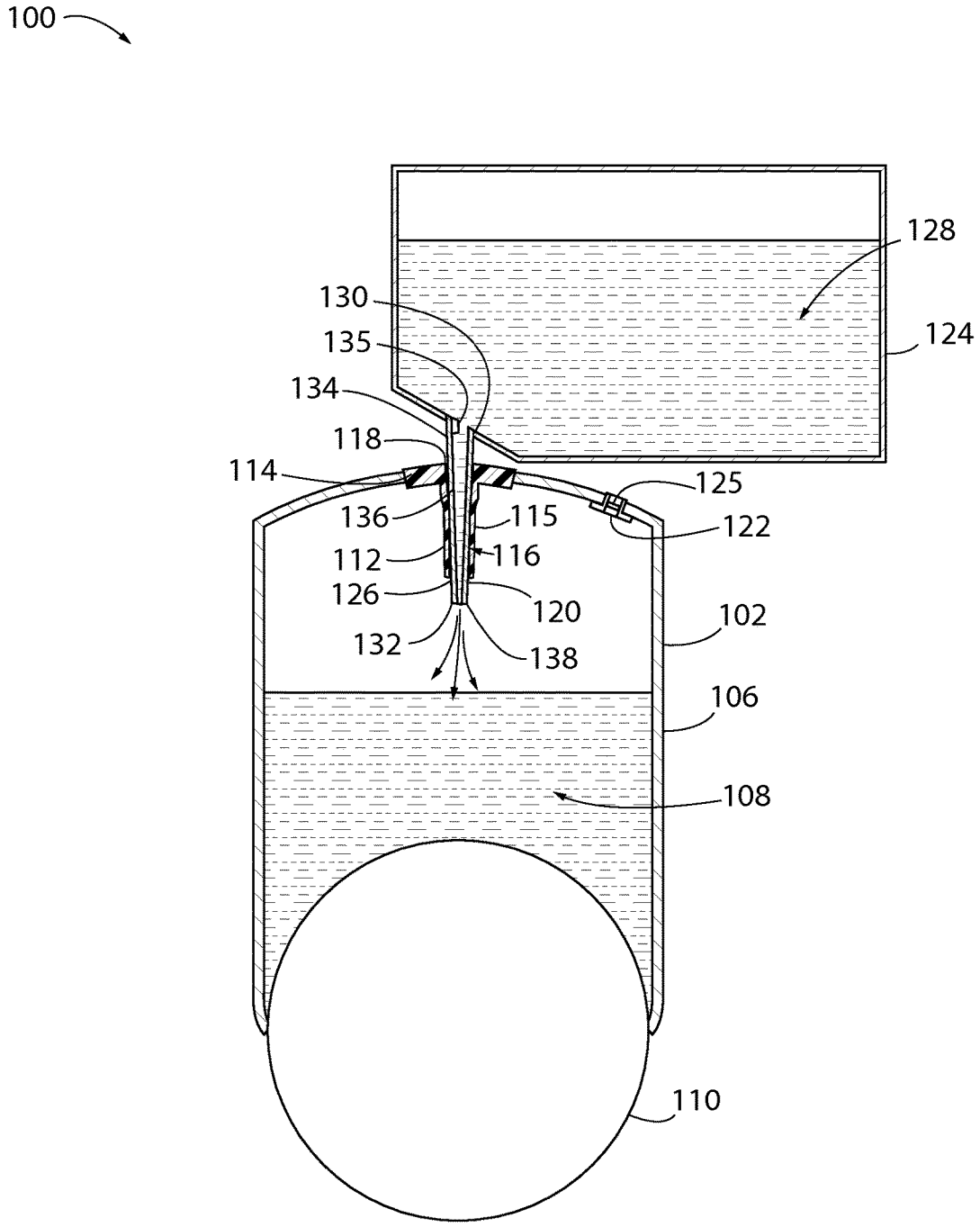
FIG. 2 illustrates a conceptual, cross-sectional view of the system in a refill configuration, according to an embodiment.

FIG. 2 illustrates a conceptual, cross-sectional view of the system 100, with the valve-piercing element 126 of the cartridge 104 received into the check valve 112, i.e., a "refill" configuration, according to an embodiment. To insert the valve-piercing element (i.e., to move from the configuration shown in FIG. 1 to that shown in FIG. 2), a movement force is applied to either or both of the dispenser 102 and the cartridge 104. Under this force, the valve-piercing element 126 is slid into the receiving end 118 of the check valve 112. As the valve-piercing element 126 slides, it may expand the elastic construction of the check valve body 115 (or push aside a flapper valve of the check valve 112, etc.), thereby increasing the diameter of the conduit 116. Upon reaching the sealing end 120, the continued sliding of the valve-piercing element 126 may expand the sealing end 120 from the zero diameter of the sealed configuration to an open configuration, as the valve-piercing element 126 extends therethrough.

When fully inserted, the opening 138 of the valve-piercing element 126 may be disposed in on otherwise communicate with the dispenser reservoir 108. Further, the check valve body 115 may be sealed around the body 134 of the valve-piercing element 126, so as to prevent fluid transmission between the bodies 134 and 115 in the conduit 116. The cartridge 104 may then be actuated, so as to deploy the fluidic contents of the refill reservoir 128 through the valve-piercing element 126, out the opening 138, and into the dispenser reservoir 108.

As the fluid from the refill reservoir 128 is received into the dispenser reservoir 108, air in the reservoir may be compressed as the generally incompressible (or, at least less compressible) fluid received into the reservoir 108 reduces the available volume for the air. The energy for such compression may be provided by the force applied to the cartridge 104 causing the fluidic contents to be expelled. When the pressure of the air in the dispenser reservoir 108 exceeds a certain threshold, the air may displace the valve element 125 from its seat in the pressure relief valve 122, thereby allowing air to escape through the pressure relief valve 122, until the pressure is reduced to below the threshold level, whereupon the valve element 125 may again close, to avoid loss of the fluidic contents therethrough.

When the reservoir 108 is filled, or the reservoir 128 is empty, or at any other point during refill, the actuation of the refill cartridge 104 may be terminated, and the valve-piercing element 126 slid out of the check valve 112. The resilient construction of the check valve body 115 may result in the conduit 116 once again being closed off, thereby preventing the contents of the reservoir 108 from escaping through the check valve 112.

What is claimed is:

1. A system for dispensing fluidic deodorant, comprising:

a dispenser defining a first reservoir therein and comprising a first check valve communicating with the first reservoir and an exterior of the dispenser; and a refill cartridge defining a second reservoir therein and comprising a valve-piercing element configured to be received through the first check valve, such that, when the valve-piercing element is received through the first check valve, the second reservoir of the refill cartridge fluidly communicates with the first reservoir of the dispenser via the valve-piercing element, wherein the refill cartridge comprises a flexible pouch, wherein the refill cartridge comprises a second check valve to retain fluid in the second reservoir until the fluid in the second reservoir is at a predetermined pressure; and the fluidic deodorant, wherein the fluidic deodorant is a non-compressible fluidic deodorant.

2. The system of claim 1, wherein the valve-piercing element extends into the first reservoir of the dispenser when the valve-piercing element is received through the first check valve.

3. The system of claim 1, wherein the valve-piercing element comprises an elongate body defining a conduit therein in communication with the second reservoir, the elongate body defining an opening in communication with the conduit.

4. The system of claim 3, wherein the opening of the elongate body extends into the first reservoir when the valve-piercing element is received through the first check valve.

5. The system of claim 3, wherein at least a portion of the first check valve seals with the elongate body when the elongate body is received into the first check valve, so as to prevent fluid flow between at least a portion of the elongate body and the first check valve.

6. The system of claim 1, wherein the first check valve defines a resiliently expandable conduit, and wherein the valve-piercing element expands a diameter of at least a portion of the resiliently expandable conduit when the valve-piercing element is received through the first check valve.

7. The system of claim 1, wherein the dispenser further comprises a pressure relief valve communicating with the first reservoir.

8. The system of claim 7, wherein the pressure relief valve is configured to open when a pressure within the first reservoir of the dispenser meets or exceeds a predetermined threshold.

9. The system of claim 7, wherein the dispenser comprises an applicator in fluid communication with the first reservoir, and wherein the pressure relief valve and the first check valve are disposed on a bottom of the dispenser, opposite from the applicator.

10. A refillable underarm deodorant dispensing system, comprising:

a dispenser comprising:

a housing defining a first reservoir therein configured to contain a fluid;

an applicator coupled with the housing, such that at least a portion of the applicator is configured to rotate relative to the housing, the applicator being configured to receive the fluid from the first reservoir;

a first check valve extending through a wall of the housing and communicating with the first reservoir, wherein the first check valve comprises a resilient body defining a first conduit extending therein, the first conduit having an open end communicating with an exterior of the housing and a sealing end communicating with the first reservoir, wherein the sealing end is biased toward a closed configuration in which fluid is prevented from traversing the first conduit; and a refill cartridge comprising:

a second housing defining a second reservoir therein, wherein the second housing comprises a flexible pouch, wherein the refill cartridge comprises a second check valve to retain fluid in the second reservoir until the fluid in the second reservoir is at a predetermined pressure; and a valve-piercing element extending from the second housing, the valve-piercing element comprising a proximal end coupled with the second housing, a distal end, and an elongate body extending between the proximal end and the distal end, the elongate body defining a second conduit therethrough and an opening positioned on or near the distal end, the opening being in communication with the second reservoir via the second conduit, wherein the elongate body of the valve-piercing element is configured to be received through the first conduit of the resilient body of the first check valve to open the sealing end of the first check valve, such that, when the elongate body is received through the first conduit of the resilient body of the first check valve, the second reservoir of the refill cartridge fluidly communicates with the first reservoir of the dispenser via the second conduit of the elongate body of the valve-piercing element.

11. The system of claim 10, wherein the elongate body of the valve-piercing element of the refill cartridge expands and seals with at least a portion of the first conduit of the resilient body of the first check valve, when the valve-piercing element is received through the first check valve.

12. The system of claim 11, wherein the dispenser further comprises a pressure relief valve communicating with the first reservoir of the dispenser, the pressure relief valve being configured to release a gas at a predetermined pressure from the first reservoir to the exterior of the housing.

13. The system of claim 10, wherein said first reservoir is configured to house the fluid at a constant ambient pressure.

14. The system of claim 1, wherein the flexible pouch is movable between a sealed configuration when no pressure is applied to the refill cartridge and a fluidly open configuration when the predetermined pressure is applied to the refill cartridge.

15. A kit, comprising:

a dispenser defining a first reservoir therein and comprising a first check valve communicating with the first reservoir and an exterior of the dispenser; and a plurality of refill cartridges, each of said refill cartridges defining a second reservoir therein and comprising a valve-piercing element configured to be received through the first check valve, such that, when the valve-piercing element is received through the first check valve, the second reservoir of the refill cartridge fluidly communicates with the first reservoir of the dispenser via the valve-piercing element, wherein the refill cartridge comprises a flexible pouch, wherein the refill cartridge comprises a second check valve to retain fluid in the second reservoir until the fluid in the second reservoir is at a predetermined pressure, wherein each of said refill cartridges comprises a non-compressible fluidic deodorant.

* * * * *